US007328895B2

(12) United States Patent
Dinatale et al.

(10) Patent No.: US 7,328,895 B2
(45) Date of Patent: Feb. 12, 2008

(54) SHEET FEEDER VACUUM FEED HEAD WITH VARIABLE CORRUGATION

(75) Inventors: Ernest L. Dinatale, Rochester, NY (US); Timothy G. Shelhart, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 411 days.

(21) Appl. No.: 11/128,724

(22) Filed: May 13, 2005

(65) Prior Publication Data

US 2006/0255525 A1 Nov. 16, 2006

(51) Int. Cl.
*B65H 5/08* (2006.01)

(52) U.S. Cl. ..... 271/11; 271/91; 271/106; 271/108

(58) Field of Classification Search ..... 271/91, 271/105, 106, 108, 132, 11
See application file for complete search history.

(56) References Cited

U.S. PATENT DOCUMENTS 5,622,362 A * 4/1997 Shiiki et al. ..... 271/91
6,264,188 B1 7/2001 Taylor et al.
6,352,255 B1 3/2002 Taylor
6,398,206 B1 6/2002 Yang et al.
6,398,207 B1 6/2002 Taylor et al.
6,398,208 B1 6/2002 Yang et al.
6,450,493 B1 9/2002 Milillo et al.
6,581,456 B1 6/2003 Clark
6,748,801 B2 6/2004 Clark
6,772,628 B2 8/2004 Clark
6,886,827 B2 * 5/2005 Dachtler ..... 271/106

OTHER PUBLICATIONS

U.S. Appl. No. 10/871,318, filed Jun. 18, 2004 by David L. Knierim, entitled Print Media Thickness Measurement System.

* cited by examiner

*Primary Examiner*—David H Bollinger
(74) *Attorney, Agent, or Firm*—James J. Ralabate; Paul F. Morgan

(57) ABSTRACT

A sheet separating and feeding system for separating a top sheet from a stack of sheets for sheet feeding, wherein a vacuum feed head has a two dimensional array of multiple vacuum tubes for vacuum engaging the top sheet, and a control system whereby at least a portion of the multiple vacuum tubes are variably positionally controlled relative to the top sheet to engage the top sheet at different levels in a different plane than the external surfaces of the other vacuum tubes so as to provide a variable three dimensional sheet corrugation inducing surface with the multiple vacuum tubes that is variable for different sheet properties.

12 Claims, 5 Drawing Sheets

SHEET FEEDER VACUUM FEED HEAD WITH VARIABLE CORRUGATION

Disclosed in the embodiment herein is an improved sheet feeding system, particularly suitable for more reliable high speed sheet separation and feeding of a wide range of different print media sheets, in which a movable pneumatic sheet acquisition feed head can have an adjustable amount of sheet corrugation which can be automatically varied in response to the properties of the particular sheets being fed.

Many types of sheet feeders have been proposed for more reliable individual sheet separations from sheet stacks, and sheet feeding, especially for higher speed sheet printing. A particular problem is the wide possible range of sheet size, weight, surface friction or other properties, including sheet stiffness,.which may range from very flimsy to relatively stiff paper or other print media sheets. The following Xerox Corporation U.S previously issued patents are noted by way of some modern examples of what are called "shuttle feeders" or "skirted shuttle feeders", with reciprocating vacuum feed heads. They are incorporated by reference to the extent relevant hereto: U.S. Pat. Nos. 6,264,188; 6,352,255; 6,398,206; 6,398,207; 6,398,208 or 6,450,493. Particularly noted is said U.S. Pat. No. 6,398,206, the title of which notes that it relates to a sheet feeder with an air plenum having a corrugated surface.

Known vacuum feed heads previously may be in the form of a box with side shields to minimize the loss of vacuum before the vacuum acquires the sheet, hence the use of the "skirted" name. However, with further increases in speed or sheet feed rates these shields may not be as effective. Sheet feeding failures are typically misfeeds and/or multifeeds (failures to separate and feed only individual sheets). The system of the present embodiment is proposed to enable elimination of the need for such vacuum feed head shields or skirts and to hopefully enable more reliable feed rates in excess of 200 ppm.

Further by way of background, it is known that the sheets basis weight or other characteristics can be manually entered by the printer operator into the machine GUI or other machine interface when stacks of sheets are being loaded into the machine. Alternatively, systems are known whereby the related measurements of sheet thickness or sheet stiffness can be measured on-line in the machine from the sheets moving therein. Noting, for example, the following U.S. patents, and other art cited therein: U.S. Pat. Nos. 6,772,628; 6,748,801; 6,581,456. Also noted is U.S. application Ser. No. 10/871,318, filed Jun. 18, 2004 by David L. Knierim entitled PRINT MEDIA THICKNESS MEASUREMENT SYSTEM (Attorney Docket No. 20031671-US-NP).

A second perceived problem with such present vacuum box feed heads is that they allow only one fixed sheet corrugation pattern. That requires a design compromise in handling the wide range of print media substrate weights from 49 gsm to 280 gsm, for example, without sheet misfeeds or multifeeds. In contrast, with the disclosed embodiment multiple different sheet corrugation patterns can be provided, to optimize the corrugation for the particular stiffness or weight of the specific print media sheets then being fed by that sheet feeder.

Variable corrugation by manually variably extending ribs or the like has also been provided in some other, different, document feeders.

A specific feature of the specific embodiment(s) disclosed herein is to provide a sheet separating and feeding system with a vacuum feed head for separating a top sheet from a stack of sheets for sheet feeding, wherein said vacuum feed head has a two dimensional array of multiple vacuum tubes for vacuum engaging and lifting the top sheet with external surfaces of said vacuum tubes, and a control system whereby at least a portion of said multiple vacuum tubes are variably positionally controlled to engage said top sheet at different levels in a different plane than other said vacuum tubes with said external surfaces thereof to provide a variable three dimensional sheet corrugation inducing surface with said external surfaces of said multiple vacuum tubes.

Further specific features disclosed in the embodiment(s) herein, individually or in combination, include those wherein said control system includes a variable cam control on said feed head of said portion of said multiple vacuum tubes that are variably positionally controlled; and/or wherein said portion of said multiple vacuum tubes that are variably positionally controlled by said control system is at least one substantially linear row of said multiple vacuum tubes; and/or wherein said control system is controlled to variably position said portion of said multiple vacuum tubes relative to said other said multiple vacuum tubes by information as to the type of sheets in said stack of sheets; and/or further including a vacuum value system controlled by said control system, and wherein said control system intermittently applies a vacuum to said vacuum feed head array of multiple vacuum tubes through said vacuum value system; and/or wherein said multiple vacuum tubes are pneumatically connected to a vacuum source to provide sheet lifting vacuum forces through the interiors of said vacuum tubes; and/or wherein at least a portion of said multiple vacuum tubes that are not controlled by said control system are freely variably vertically movable between defined limits with gravitational and applied vacuum forces to variably form three dimensional surface configurations; and/or a sheet separating and feeding method in which a vacuum feed head separates a top sheet from a stack of sheets for sheet feeding, comprising providing vacuum forces for engaging and lifting said top sheet through a two dimensional array of multiple repositionable vacuum tubes in said feed head, variably controlling at least a portion of said multiple vacuum tubes to variably positionally engage said top sheet at different levels in a different plane than other said vacuum tubes to provide a variable three dimensional sheet corrugation inducing surface with said multiple vacuum tubes, said variable controlling being controlled to provide a selected different said variable three dimensional sheet corrugation inducing surface with said multiple vacuum tubes appropriate for said separating and feeding of said sheets in said stack of sheets; and/or wherein said portion of said multiple vacuum tubes that are so variably controlled comprises at least one substantially linear row of said multiple vacuum tubes; and/or wherein said variable control is controlled by information as to the type of sheets in said stack of sheets; and/or further including controlling a vacuum value system to intermittently apply a vacuum to said multiple vacuum tubes through said vacuum value system; and/or wherein said multiple vacuum tubes are pneumatically connected to a vacuum source to provide sheet lifting vacuum forces through the interiors of said vacuum tubes; and/or wherein at least a portion of said multiple vacuum tubes that are not controlled by said control system are freely variably vertically movable between defined limits with gravitational and applied vacuum forces to variably form three dimensional surface configurations.

The disclosed system may be operated and controlled by appropriate operation of conventional control systems. It is well known and preferable to program and execute various printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed.

As to specific components of the disclosed apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be-described herein.

Various of the above-mentioned and further features and advantages will be apparent to those skilled in the art from the specific apparatus and its operation or methods described in the example below, and the claims. Thus, they will be better understood from this description of one specific embodiment, including the drawing figures (which are approximately to scale) wherein:

Describing now in further detail this exemplary embodiment with reference to the Figures, there is shown a print media sheet separator and feeder system 10 with a feed head 20, for feeding sheets 12 from a stack 14.

Figure 5:
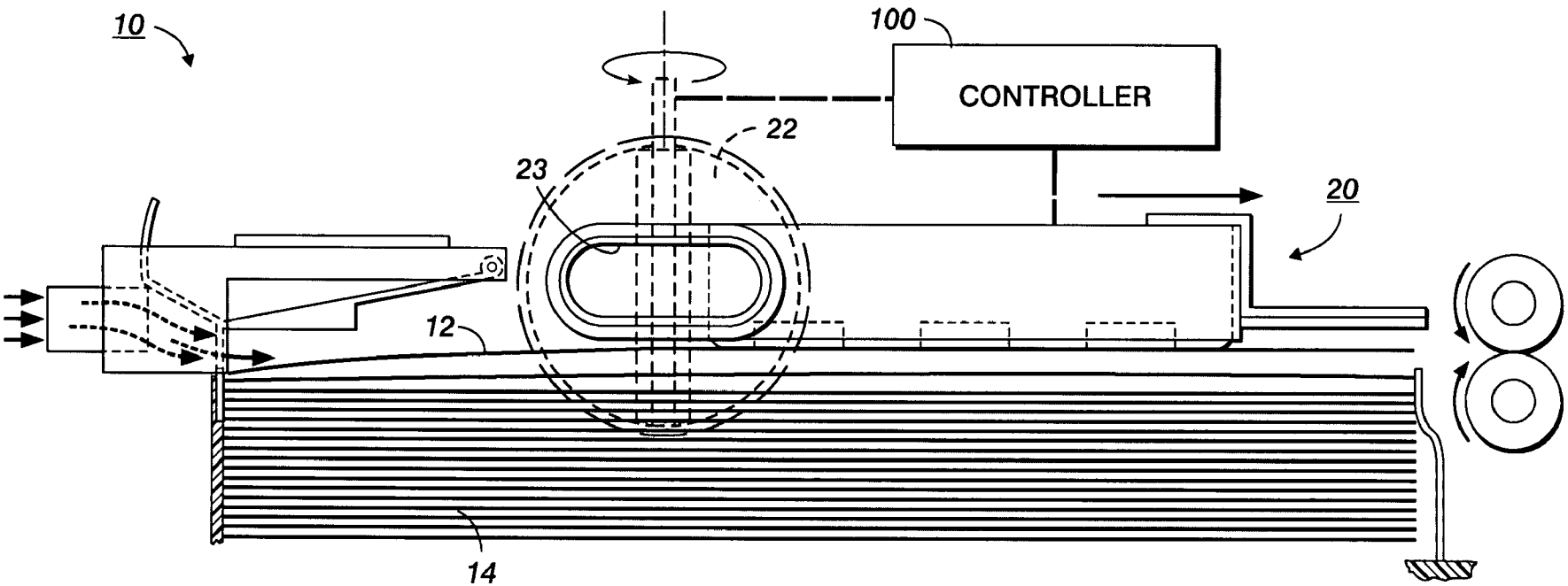
FIG. 5 shows the feed head of FIGS. 1-4 in one example of an otherwise known shuttle feeder system for acquiring and feeding the top sheet of a stack of sheets for a printer.

As shown in FIG. 5, this system. 10 may be a "shuttle feeder" system (as in the above-cited patents) in which the feed head 20 may be reciprocated substantially parallel to the stack surface after a sheet 12 acquisition for the initial downstream feeding of that sheet into take-away rollers, and back. Known air knives or air fluffers may be used to help fluff up the stack to assist in the top sheet 12 acquisition by the feed head 20. However, since these aspects of such sheet feeders are well known, they need not be re-described herein.

Figure 1:
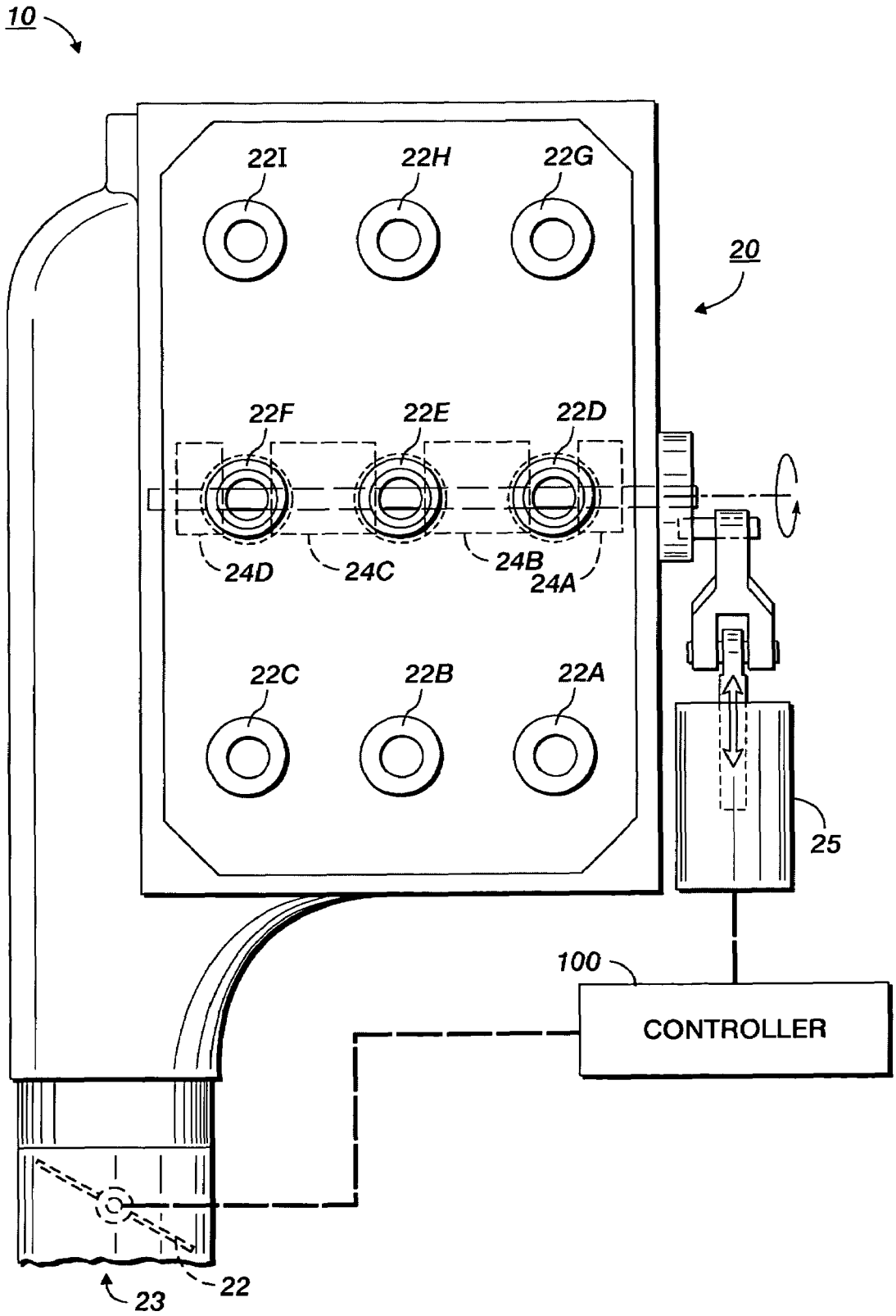
FIG. 1 is a bottom view of one example of the subject variable corrugation sheet feed head with multiple vacuum ports.

The feed head 20 shown here acquiring the substrate 12, is a vacuum box with multiple vacuum tubes 22A-22I that may drop down to contact the fluffed substrate 12. When the vacuum is turned on, e.g., by the valve 22 in the vacuum input 23 controlled by controller 100 as shown in FIG. 1, the vacuum tubes 22 will pull the top sheet 12 up. By respective vacuum tubes 22 being programmed to move up a different height or distance in relation to one other, as in the example herein, a desired sheet 12 corrugating pattern may be created. The actual sheet 12 corrugations may also vary depending on the weight, stiffness, and size of the particular. This is advantageous over a single corrugation pattern to feed all different substrates.

The multiple vacuum tubes 22A-22I may move up and down freely or telescope by gravity and may have conventional stops to limit their up upward and downward movement ranges.

Figure 2:
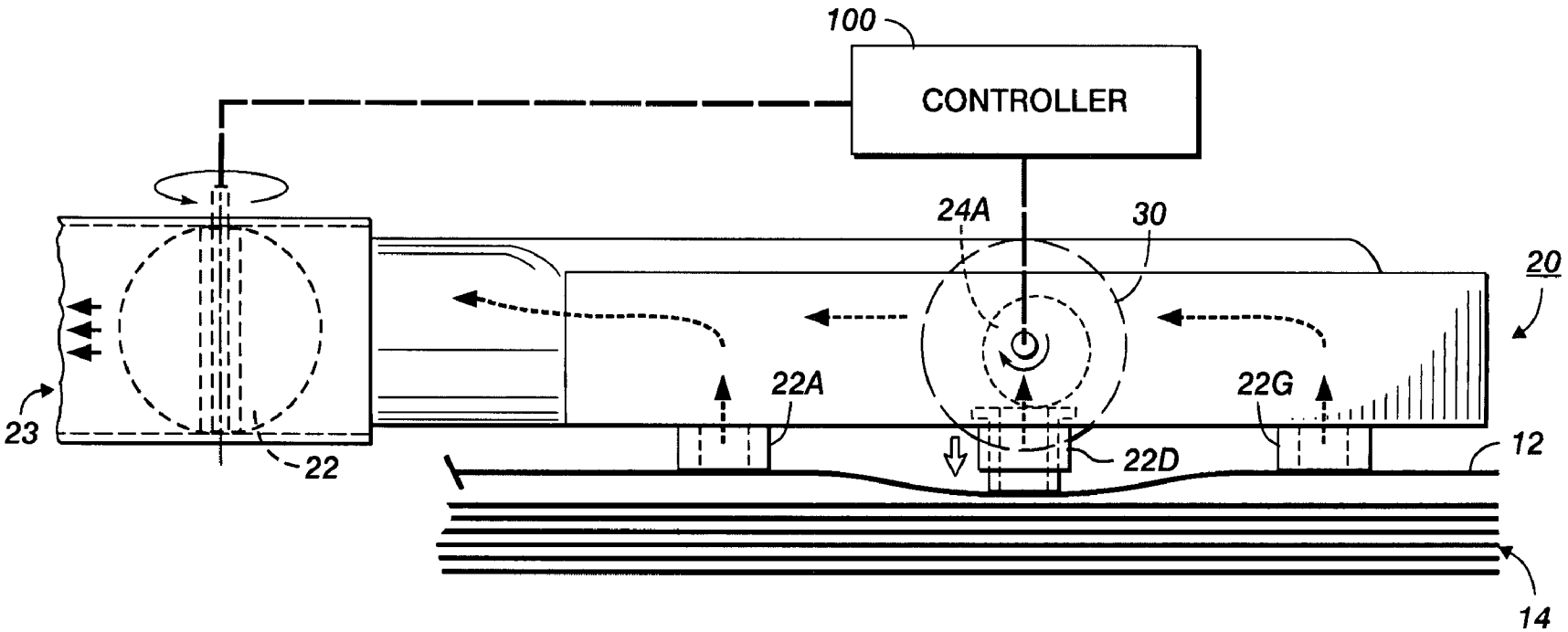
FIG. 2 is a partial side view of the feed head of FIG. 1, showing one of the variably extending variable sheet corrugation positions of one of the sets of vacuum ports, and a stepper motor instead of a solenoid.
Figure 3:
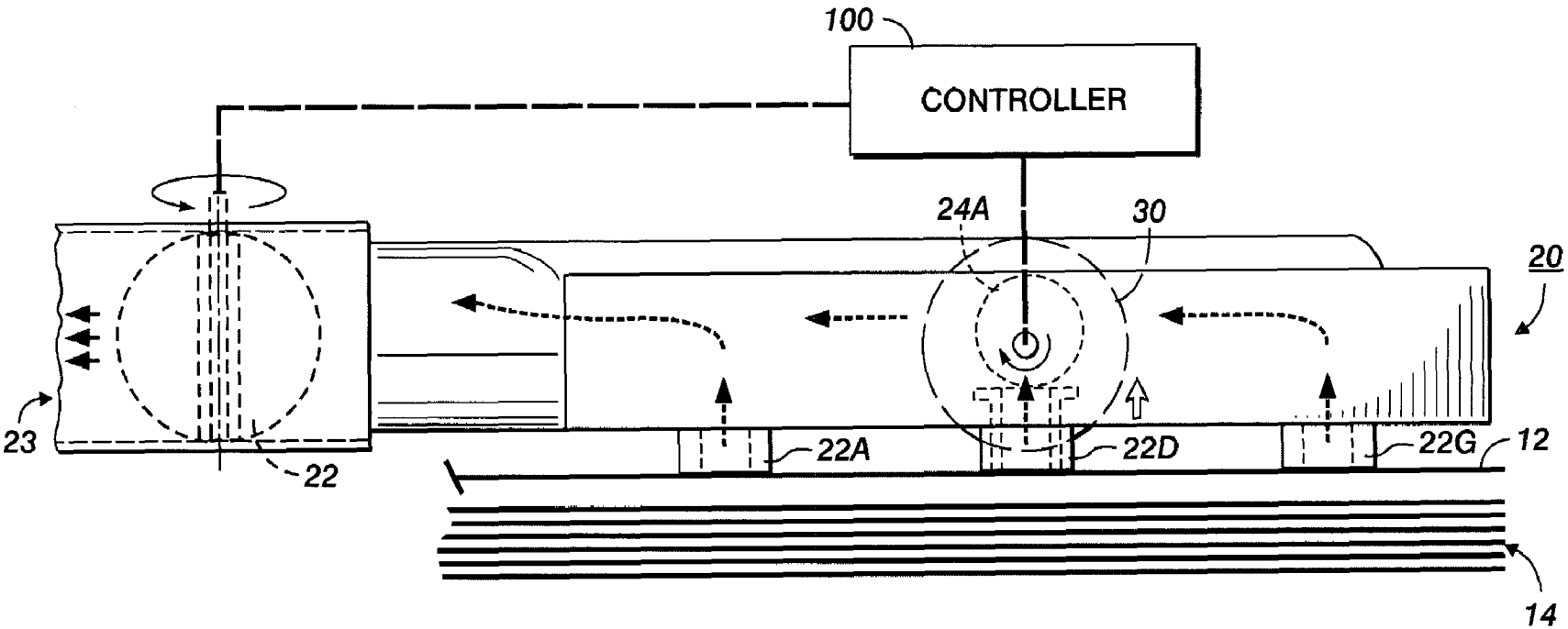
FIG. 3 is the same as FIG. 2 but showing a non-corrugating position of the same set of repositionable vacuum ports.
Figure 4:
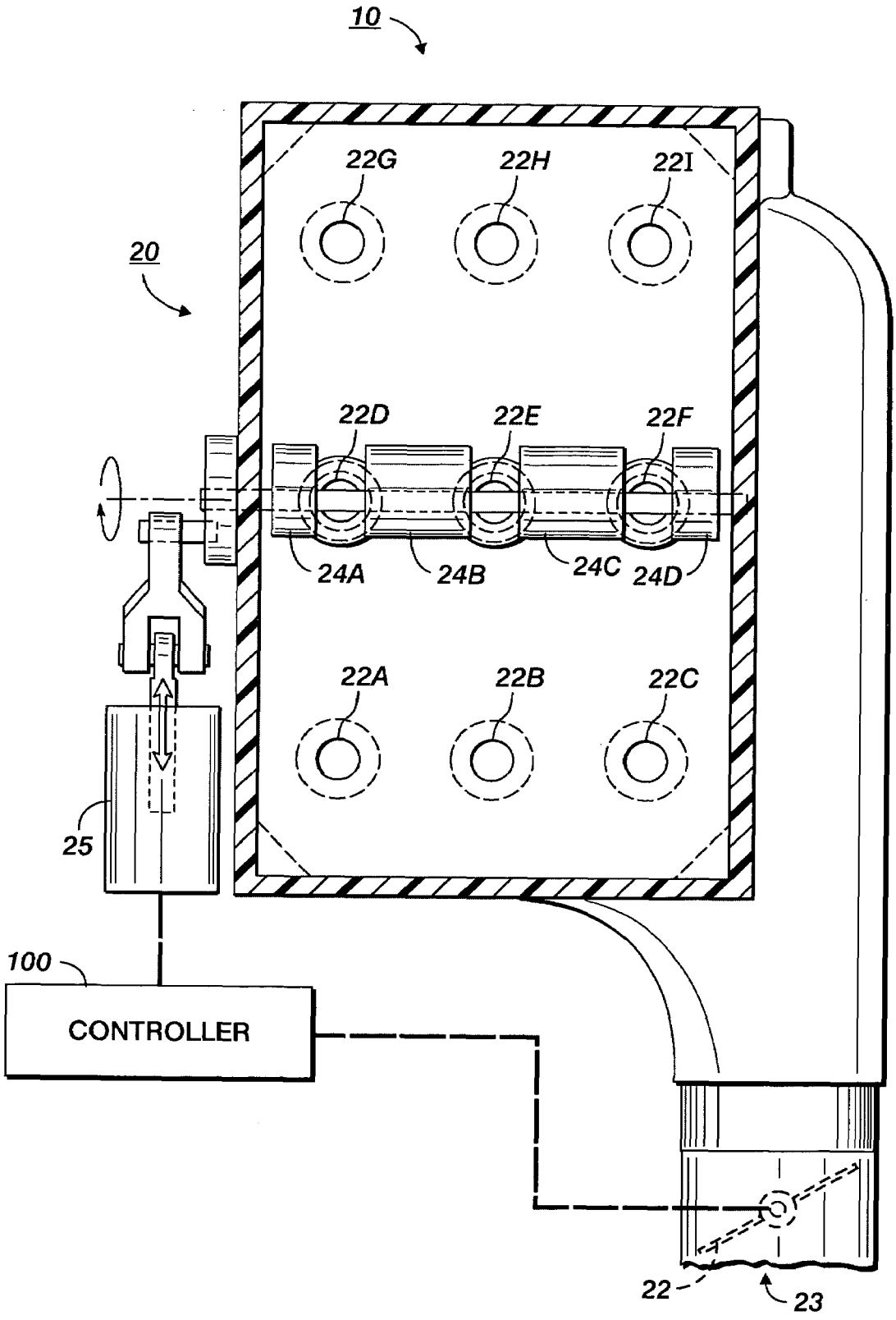
FIG. 4 is a partially cut-away top view of the feed head of FIGS. 1-3.

In this example, the corrugation pattern is varied and controlled by a cam bank 24A-24D acting on at least one set the vacuum tubes 22D, 22E, and 22F rotated by a stepper motor 30 as in FIG. 2 or 3, or the variable force solenoid 25 in FIGS. 1 and 2. This will provide the optimum corrugation pattern for feeding the particular sheets in the stack being fed, desirably based on input to the controller 100 of the weight (gsm) of the substrate being feed, as previously described or otherwise, or even based on operator observed misfeeds or multiple feeds. Stepper motor 30 rotation allows an infinite number of cam controlled positions for those vacuum tubes 22D, 22E, and 22F, which results in an infinite number of corrugation patterns. When the customer inputs the gsm of the substrate being feed, the stepper motor 30 will turn to a specified position to give the optimum position for the moving vacuum tubes. As a result the most suitable corrugation pattern depending on the weight (gsm) of the substrate being feed can be provided. The cam bank 24A-24D may be keyed to the vacuum tubes 22D, 22E, and 22F or coil springs can be provided around the vacuum tubes to maintain contact control between the tops of these vacuum tubes and the cam surfaces. It will be appreciated that this is merely one example of many possible simple mechanisms by which part of the sheet vacuum attractive orifices of the feed head may be maintained at a different level or levels from others to impart a sheet corrugating force on the sheet to assist its separation and/or feeding from the sheet stack. While in this example tubes 22D, E and F are shown as additionally controlled by the stepper driven cam system, it will be appreciated that similar, or different, controls can be provided for the other tubes, for increased or different corrugation(s).

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A sheet separating and feeding method in which a vacuum feed head separates a top sheet from a stack of sheets for sheet feeding, comprising:

providing vacuum forces for engaging and lifting said top sheet through a two dimensional array of multiple repositionable vacuum tubes in said feed head, variably controlling at least a portion of said multiple vacuum tubes to variably positionally engage said top sheet at different levels in a different plane than other said vacuum tubes to provide a variable three dimensional sheet corrugation inducing surface with said multiple vacuum tubes, said variable controlling being controlled to provide a selected different said variable three dimensional sheet corrugation inducing surface with said multiple vacuum tubes appropriate for said separating and feeding of said sheets in said stack of sheets.

2. The sheet separating and feeding method of claim 1, wherein said portion of said multiple vacuum tubes that are so variably controlled comprises at least one substantially linear row of said multiple vacuum tubes.

3. The sheet separating and feeding method of claim 1, wherein said variable control is controlled by information as to the type of sheets in said stack of sheets.

4. The sheet separating and feeding method of claim 1, further including controlling a vacuum value system to intermittently apply a vacuum to said multiple vacuum tubes through said vacuum value system.

5. The sheet separating and feeding method of claim 1, wherein said multiple vacuum tubes are pneumatically connected to a vacuum source to provide sheet lifting vacuum forces through the interiors of said vacuum tubes.

6. The sheet separating and feeding method of claim 1, wherein at least a portion of said multiple vacuum tubes that are not controlled by said control system are freely variably vertically movable between defined limits with gravitational and applied vacuum forces to variably form three dimensional surface configurations.

7. A sheet separating and feeding system with a vacuum feed head for separating a top sheet from a stack of sheets for sheet feeding, wherein said vacuum feed head has a two dimensional array of multiple vacuum tubes for vacuum engaging and lifting the top sheet with external surfaces of said vacuum tubes, and a programmed computerized control system whereby at least a portion of said multiple vacuum tubes are variable positionally controlled to engage said top sheet at different levels in a different lane than other said vacuum tubes with said external surfaces thereof to provide a variable three dimensional sheet corrugation inducing surface with said external surfaces of same multiple vacuum tubes, and wherein said control system includes a variable cam control on said feed head of said portion of said multiple vacuum tubes that are variable positionally controlled.

8. The sheet separating and feeding system of claim 7 wherein said portion of said multiple vacuum tubes that are variably positionally controlled by said control system is at least one substantially linear row of said multiple vacuum tubes.

9. The sheet separating and feeding system of claim 7 wherein said control system is controlled to variably position said portion of said multiple vacuum tubs relative to said other said multiple vacuum tubes by information as to the type of sheets in said stack of sheets.

10. The sheet separating and feeding system of claim 7, further including a vacuum value system controlled by said control system, and wherein said control system intermittently applies a vacuum to said vacuum feed head array of multiple vacuum tubes through said vacuum value system.

11. The sheet separating and feeding system of claim 7 wherein said multiple vacuum tubes are pneumatically connected to a vacuum source to provide sheet lifting vacuum forces through the interiors of said vacuum tubs.

12. The sheet separating and feeding system of claim 7, wherein at least a portion of said multiple vacuum tubes that are not controlled by said control system are freely variably vertically movable between defined limits with gravitational and applied vacuum forces to variably form three dimensional surface configurations.

* * * * *